US005458669A

United States Patent [19]

Maeda et al.

[11] Patent Number: 5,458,669

[45] Date of Patent: Oct. 17, 1995

[54] PROCESS FOR PURIFICATION OF GALLIUM MATERIAL

[75] Inventors: Hideo Maeda; Hidekimi Kadokura, both of Eihame, Japan

[73] Assignee: Sumitomo Chemical Company, Limited, Osaka, Japan

[21] Appl. No.: 141,552

[22] Filed: Oct. 27, 1993

[30] Foreign Application Priority Data

Oct. 28, 1992 [JP] Japan ..... 4-290037

[51] Int. Cl.[6] ..... C22B 58/00

[52] U.S. Cl. ..... 75/10.67; 75/688

[58] Field of Search ..... 75/10.67, 688

[56] References Cited

FOREIGN PATENT DOCUMENTS

| | | | |
|---|---|---|---|
| 3712989 | 1/1990 | Australia . | |
| 349449 | 1/1990 | European Pat. Off. | 75/688 |
| 57-60040 | 4/1982 | Japan . | |
| 62-270494 | 11/1987 | Japan . | |
| 250927 | 2/1990 | Japan . | |
| 250926 | 2/1990 | Japan . | |
| 5148559 | 6/1993 | Japan . | |

*Primary Examiner*—Melvyn Andrews

[57] ABSTRACT

A process for the purification of a raw gallium material to produce a purified gallium material having a higher purity than that of the raw gallium material having steps of:

maintaining the raw gallium material in its melted condition within a vessel having a means, for example a tube, positioned at or near a center portion of an inside of the vessel, through which means a cooling medium is passed, and keeping the raw gallium material in the vessel at a controlled temperature so that the purified gallium material is deposited on an outer surface of the means.

7 Claims, 1 Drawing Sheet

PROCESS FOR PURIFICATION OF GALLIUM MATERIAL

BACKGROUND OF THE INVENTION

1. Field of the Invention

The present invention relates to a process for the purification of a gallium material. Particularly, the present invention relates to a process for the purification of a raw gallium material in which the raw gallium material having impurities is purified to produce a gallium material having a higher purity (namely, a purified gallium material) than that of the raw gallium material by solidifying in the raw gallium material in its melted condition on the basis of the principle of fractional crystallization.

2. Description of the Related Art

Gallium has excellent properties as a material from which electronic materials are produced for semiconductor elements and emitting elements, and thus demand for this material has increased in recent years.

A gallium material is usually produced by electrolysis of a by-product from the production of, for example, aluminum. The purity of such a gallium material is about 99.999%. However, gallium material to be used as the raw material for the production of the semiconductor elements is required to have a purity of not less than 99.9999%, so that the gallium material usually should be further purified to have a higher purity.

A known process for the further purification of the gallium material includes, for example, the electrolysis purification process, the fractional crystallization process, the zone melting process and the single crystal lifting process.

In the electrolysis purification process, a crude (or raw) gallium material is applied to an anode, gallium and metals which are baser than gallium are dissolved in an aqueous solution, and gallium and metals which are nobler than gallium electro-deposit on a cathode. However, it is said that the purity of the produced gallium material is in the order of 99.999% due to the presence of contamination by the electrodes and/or the difficulty in obtaining an aqueous gallium solution having a high purity.

The fractional crystallization process, the zone melting process and the single crystal lifting process each utilize a segregation phenomena of impurities and are, in principle, effective processes, since equilibrium distribution coefficients of the impurities to metallic gallium are extremely small. However, there are a few exceptions.

In the zone melting process, a melted zone of a gallium material in the form of a band is moved repeatedly and slowly and the impurities are removed into the melted zone. However, operation of the process is said to be difficult due to supercooling of gallium.

The single crystal lifting process purifies a raw gallium material utilizing segregation, in which a tip portion of a cooled seed crystal is contacted with a melted raw gallium material and the seed crystal, on a portion of which a single crystal of gallium grows is lifted gradually. Productivity and yield of the process are extremely poor.

The fractional crystallization process purifies a raw gallium material utilizing segregation, in which solidification is slowly carried out in a melted gallium raw material. Since solid gallium is lighter than liquid gallium, the solid gallium floats in the form of a small mass on a surface of the liquid gallium, when the surface is kept still at a temperature below the melting point of gallium. The floated solid gallium is thereby separated. However, since the melted raw material containing the impurities attaches to surfaces of the solid mass, it is difficult to obtain the gallium material having a high purity.

Japanese Patent Kokai Publication No. 62-270494 discloses a process in which seed crystals are present in a melted raw gallium material and a surface of the melted raw gallium material is cooled with a gas to a temperature less than its melting point, so that a gallium material is solidified on the seed crystals as nuclei with unidirectly solidification. When a solidification rate is not uniform during the operation, impurities concentrated in the melted material are likely to be taken into the solid gallium material. Alternatively, when the solidification configuration does not proceed uniformly, the solid gallium material is likely to catch the melted gallium material in which the impurities are concentrated. As a result, the purity of the solid gallium material is decreased and its quality becomes unstable. Thus, the purification process requires accurate operation control.

SUMMARY OF THE INVENTION

The present inventors have made intensive studies so as to provide a process for purifying a raw gallium material to produce a purified gallium material having a higher purity (and thus having less impurities) effectively, with an economical cost, and which is simpler in operation and apparatus, and thus have made the present invention, in which a simpler apparatus for the fractional crystallization is used.

According to the present invention, there is provided a process for the purification of a raw gallium material to produce a purified gallium material having a higher purity than that of the raw gallium material, which process comprises steps of:

maintaining the raw gallium material in its melted condition within a vessel having a means, for example a tube, positioned at or near a center portion inside of the vessel, through which means a cooling medium is passed, and keeping the raw gallium material in the vessel at a controlled temperature; so that the purified gallium material is deposited on an outer surface of the means.

In one preferred embodiment of the present invention, the melted raw gallium material is rotated by a magnetic coil applied around a side surface of the vessel which coil produces a rotational magnetic field.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
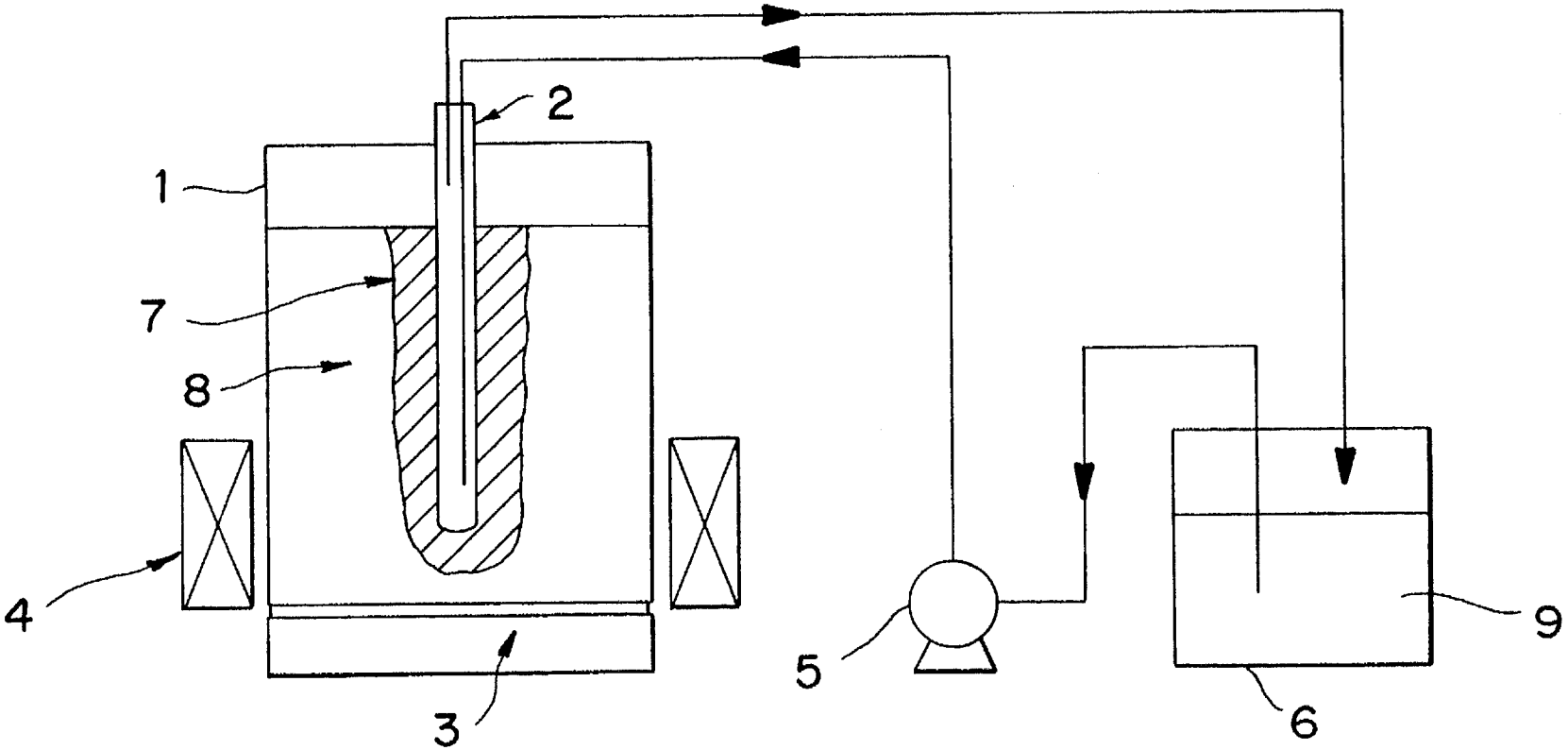
FIG. 1 schematically shows a flow sheet of one embodiment of an apparatus which is used in the present purification process of the gallium material.

The present process will be, hereinafter, explained with reference to the accompanying drawing which are given by way of illustration only, and thus are not limiting of the present invention.

Referring to FIG. 1, the number 1 indicates the vessel in which the melted raw gallium material is provided. The means, such as a tube, through which the cooling medium is passed is represented by the number 2; a heating means which generates heat to melt the raw gallium material and/or to keep the raw gallium material in its melted condition is represented by 3; a magnetic coil to produce the rotational magnetic field is represented by 4; a pump to circulate the cooling medium through the means is represented by 5; a vessel to reserve the cooling medium is represented by 6; the purified gallium material is represented by 7; the melted raw gallium material is represented by 8; and the cooling medium is represented by 9.

The raw gallium material which is used in the present purification process is contained in the vessel 1 in its melted condition.

The material from which the vessel 1 is made is not specifically limited and may be any suitable material, provided that it does not contaminate the melted gallium. For example, the vessel may comprise Teflon on at least the portions which contact the melted raw gallium material.

The solid gallium material has a melting point of about 30° C. Thus, the raw gallium material may be melted in another vessel, and then charged into the vessel 1 and kept in its melted condition therein. Alternatively, the solid gallium material is initially charged in the vessel 1 and then heated to melt the material therein.

In order to heat the vessel (and to melt the raw gallium material therein) and/or to maintain the temperature of the vessel (and thus the melted raw material), it is very convenient to place the vessel 1 on a heat source 3 such as a heating plate. In another embodiment, the vessel itself may be placed in a temperature controlled chamber so that the vessel 1 is heated as a whole and the temperature of the contents therein is kept controlled. In a further embodiment, the vessel 1 may be immersed in an oil bath and the like so that the temperature of the vessel is kept controlled. Any temperature maintaining and controlling means or procedure may be employed, so long as the contents in the vessel 1 is kept in its melted condition.

In the present process, the means 2, such as a tube, through which the cooling medium is passed is provided at or near a center portion of the inside of the vessel 1 and preferably the upper center portion of the inside of the vessel 1 as shown in FIG. 1. The cooling medium 9 is pump-circulated through the tube 2 by the circulation pump 5, thereby the purified gallium material deposits on and covers a surface of the tube.

The term "at or near a center portion of the inside of the vessel" is intended to mean that the means such as a tube is not provided excessively close to a side surface and/or the bottom surface of the vessel 1. That is, the means is provided in the vessel as remote from any wall of the vessel as possible within an acceptable extent.

The means through which the cooling medium is passed is any means which cools the melted raw gallium material around itself. For example, a single straight tube, one end of which is closed, may be used. Any other suitable means such as an elongated cone shaped means, an elongated frustum shaped means, and any combination thereof, also may be used. Among these, the single straight tube is the most preferable from the view point of ease of its production and operation.

As to the cooling medium, there is no limitation, provided that it functions to cool the melted gallium material around the tube. For example, water, water containing a freezing-point depressant, such as an alcohol or ethylene glycol, or a non aqueous solvent, such as a silicone oil, may be used. Water is usually used.

The cooling medium is usually supplied to the means 2 through a tube which is deeply immersed in the means filled with the cooling medium and withdrawn through a tube which is relatively shallowly dipped in the means 2, as shown in FIG. 1. In a preferred embodiment, a temperature and a flow rate of the cooling medium are controlled such that a temperature of a melted gallium material portion is kept in the range of 0° to 25° C., more preferably in the range of 0° to 20° C. in the vicinity of the means 2.

When a rapid deposition rate of the purified gallium material is desired, a temperature of the cooling medium may be decreased and/or the flow rate of the cooling medium through the tube increased. When a better-purified gallium material having less impurities is desired, the operation conditions for the deposition of the purified gallium material (e.g. the temperature and the flow rate of the cooling medium) are so controlled that a crystal growing rate of the purified gallium material on the surface of the cooling medium tube can be achieved in the range of about 5–30 mm/hr and preferably about 10–20 mm/hr.

A material from which the means 2 is made is not specifically limited, provided that it does not contaminate the melted gallium material. For example, a Teflon means may be used.

It is, of course, possible to use a means made of a metal having its outer surface coated with a material, such as Teflon, which does not contaminate the melted gallium material. This is also applicable to the material from which the vessel 2 is made.

The purified gallium material gradually solidifies and deposits on the outer surface of the cooling medium tube 2. In order to make the purification effective, the purification operation should be terminated before a tip portion of the depositing purified gallium material 7 on the tube 2 reaches an inside surface of the vessel 1.

When the solidification of the purified gallium material is carried out without agitation of the melted gallium material 8, the solidification is likely to proceed preferentially in a certain direction so that the tip portion of the purified gallium material 7 in that direction comes into contact with the inside surface of the vessel 1, even when the temperature of the melted gallium material is well controlled. Therefore, it is preferable that the purification operation should be terminated, usually when the solidification ratio (defined as "an amount of the purified gallium material/an amount of the raw gallium material") is in the range of about 30 to 40%.

In order to achieve a uniform solidifying rate on the surface of the cooling medium tube 2, the melted gallium material is preferably agitated.

The agitation is carried out so that there is substantially no temperature distribution in the bulk of the melted gallium material. Usually, an agitation rate greater than about 0.2 cm/sec. is sufficient. However, too vigorous agitation may entrain into the melted gallium material an oxide layer which is formed as an upper surface of the melted gallium material in the vessel 1, thereby contaminating the melted gallium material with the oxide layer.

The agitating manner of the melted gallium material is not specifically limited, provided that the entrainment of the oxide layer and the broad temperature distribution across the bulk of the melted gallium material are substantially avoided. As one example of an agitating manner which satisfies such requirements, agitation with a magnetic coil 4, as shown in FIG. 1, which provides a rotational magnetic field, is effective. The agitation with such a magnetic coil may be controlled easily and accurately by varying the number of turns of the coil, varying the current through the coil and/or varying the frequency of the current.

The temperature of the melted gallium material can be kept uniform easily and accurately in combination with the controlled agitation with the magnetic coil upon the solidification and the deposition of the purified gallium material, so that a high yield, such as a solidification ratio in the range of about 60 to 70%, may be achieved.

When the purification operation is terminated, the tube 2, on the surface of which the purified gallium material 7 has solidified and deposited, is removed from the vessel 1 and heated in an atmosphere within another vessel by heating the atmosphere. In another embodiment, the purified gallium material is directly heated to a temperature in the range of about 50°–100° C. in an atmosphere of air so that the purified gallium material is obtained. Alternatively, a heating medium is passed through the tube 2, whereby only the purified gallium material is easily separated from the tube 2 to obtain the purified gallium material.

According to the present invention, using fractional crystallization, the (raw) crude gallium material is effectively purified at lower cost, using a simpler apparatus while the melted gallium material in the vessel containing the concentrated impurities is kept out of the purified gallium material, which has been difficult in the prior art process. Therefore, the present invention is extremely useful from its industrial view point.

The contents of the impurities in the purified gallium material according to the present invention depends on the raw gallium material to be purified.

EXAMPLES

Although the present process will be, hereinafter, described in detail with reference to Examples, it should be noted that they merely demonstrate the embodiments of the present invention and they do not limit the scope of the present invention.

Example 1

A melted gallium material (8) of 4 kg containing Sn of 53 ppm and Pb of 57 ppm was charged in a Teflon vessel (1) having an inner diameter of 100 mm. A Teflon tube (2) having an outer diameter of 22 mm through which the cooling medium was passed, was positioned in the upper center portion of the vessel (1) as shown in FIG. 1. The vessel (1) was placed on the heating plate (3) which was heated to a temperature of 40°–45° C., so that the gallium material was maintained as a melt, and thus a purified gallium material (7) was fractionally deposited on the outer surface of the tube (2).

The cooling medium used was water and its temperature was 2° C. The cooling medium was circulated with a pump (5) at a flow rate of 270 ml/min.

The purification was continued for six hours, and then the purified gallium material (7) was withdrawn from the vessel (1) as a fractionally crystallized mass. The purified gallium material had a weight of 1.2 kg. In this Example, no agitation of the melted gallium material was used during the fractional deposition operation.

Then, a portion of the purified gallium material mass was melted and a sample was prepared for SSMS (spark ion source mass spectrum analysis) and then analyzed with SSMS. The purified gallium material contained Sn of 0.7 ppm and Pb of 1.1 ppm.

Example 2

Example 1 was repeated (namely, the same amount of the same raw gallium material was used under the same operating conditions as in Example 1) except that the magnetic coil (4) (the number of turns of which was 100) which provides the rotational magnetic field was positioned around the side surface of the Teflon made vessel (1), as schematically shown in FIG. 1.

The melted gallium material was rotated by the coil (4) with the rotational magnetic field provided under conditions of a frequency of 15 Hz and a current of 1.5 A. The field strength was 20 G (gauss) at the side surface of the vessel.

The purification operation was continued for 15 hours, and then the fractionally crystallized mass was taken out from the vessel (1). The weight of the mass was 2.5 Kg.

The mass was analyzed and it was found that it contained Sn of 0.9 ppm and Pb of 1.7 ppm.

Comparative Example 1

The same amount of the same raw gallium material having the same impurities charged in the same vessel as in Example 1 was purified. A seed crystal having a size of 3 mm was added to the melted raw gallium material. The vessel was left in an atmosphere at a temperature of 28°–30° C. so that natural solidification occurred.

The solidification was continued for 48 hours and then the fractionally crystallized mass was withdrawn. The fractionally crystallized mass had a total weight of 2.8 kg.

The mass was analyzed as in Example 1 and it was found that it contained Sn of 4.5 ppm and Pb of 6.6 ppm.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for the purification of a raw gallium material to produce a purified gallium material having a higher purity than that of the raw gallium material, which process comprises the steps of:

providing a vessel and a tube which extends into said vessel at a position at or near the center thereof, said tube having one end which is closed, circulating a cooling medium through said tube, maintaining the raw gallium material in a melted condition within said vessel, magnetically stirring the melted raw gallium material within said vessel, and maintaining the raw gallium material in the vessel at a controlled temperature so that the purified gallium material is deposited on the outer surface of the tube.

2. The process of claim 1, wherein the magnetic stirring is achieved by providing a magnetic coil at an outside surface of the vessel, said magnetic coil imparting a rotational magnetic field to the raw gallium material.

3. The process of claim 1, wherein the cooling medium maintains the melted gallium material at a temperature of 0° to 25° C. in the vicinity of the tube.

4. The process of claim 1 wherein, when the purification operation terminates, the tube containing solidified, purified gallium material deposited on its surface is removed from the vessel and heated to obtain the purified gallium material.

5. The process according to claim 1, wherein the tube is a straight tube and the cooling medium is continuously introduced into and removed from the tube.

6. The process according to claim 1, wherein the purified gallium material is deposited at a crystal growing rate of about 5– 30 mm/hr.

7. The process according to claim 1, wherein the purified gallium material is deposited at a solidification ratio of about 60–70%.

* * * * *